United States Patent [19]

Johnson, Jr.

[11] Patent Number: 4,867,504

[45] Date of Patent: Sep. 19, 1989

[54] BOOSTER SEAT

[75] Inventor: Stanley A. Johnson, Jr., Brookfield, Wis.

[73] Assignee: The Vollrath Company, Inc., Sheboygan, Wis.

[21] Appl. No.: 162,754

[22] Filed: Mar. 1, 1988

[51] Int. Cl.[4] ..... A47D 1/04

[52] U.S. Cl. ..... 297/3; 297/250; 297/239

[58] Field of Search ..... 297/1, 3, 239, 250

[56] References Cited

U.S. PATENT DOCUMENTS

| | | | |
|---|---|---|---|
| 3,285,660 | 11/1966 | Beckman et al. | 297/1 |
| 4,181,352 | 1/1980 | Bumpus | 297/3 |
| 4,521,052 | 6/1985 | Cone | 297/1 |

FOREIGN PATENT DOCUMENTS

| | | | |
|---|---|---|---|
| 2409127 | 9/1975 | Fed. Rep. of Germany | 297/3 |

OTHER PUBLICATIONS

Service Merchandise 198 Catalog p. 65 showing two booster seats.

Cambro 198 Catalog p. 70 showing its Babysitter Booster Seat.

Continental 198 Catalog p. 41 showing its Dual Booster Seat.

Cambro 198 Catalog p. 74 showing two booster seats.

Rubbermaid Flyer dated Oct. 1986 showing its Sportster Booster Seat.

*Primary Examiner*—Francis K. Zugel

*Attorney, Agent, or Firm*—Olson & Hierl

[57] ABSTRACT

A booster seat is provided which has two different booster heights and two corresponding seat sizes, and is capable of nesting in a second booster seat. The booster seat has two chairs portions each having a seat surface, a back support and two arm supports which define seat pockets. The first chair portion seat surface, back support and arm supports are smaller than the second chair portions seat surface, back and arm supports. The first chair portions has an outer circumference defined by its back support and arm supports which is small enough to nest in the second seat pocket. Both the first chair portion and the second chair portion are able to act as bases, and are connected to each other such that the first chair portions acts as a base for the second chair portion and the second chair portion acts as a base for the first chair portion.

15 Claims, 1 Drawing Sheet

BOOSTER SEAT

FIELD OF THE INVENTION

The present invention relates to children's booster seats.

BACKGROUND OF THE INVENTION

Devices designed to seat children at a table to eat with adults are well known in the art. When they are first old enough to sit independently without the aid of neck support, children (known in the industry at this age as toddlers) are seated at the table by use of a high chair.

Such high chairs have typically been free-standing devices employing a small, upper chair portion designed to fit such toddlers, a tray for food placement, and elongated legs to elevate the toddler to table level. More recently, the small, upper chair portions have been attached to arms which securely grip the table top to elevate the upper chair portion and tray to table level without the use of cumbersome legs.

While such high chair devices are satisfactory for use with toddlers, they are quickly outgrown by sprouting children. Children eventually become large enough to reach table level and eat off the table while sitting on standard adult chairs. The growth lapse between outgrowth of high chairs and use of adult chairs is typically about 12 inches in the child's height. Thus, for this growth period, arrangements must be made to boost the child up to table level so the child can eat off the table.

Toward this end, various booster seats have been developed which are placed on adult seats to raise the level of the child. The most common of these is a box-like device which includes an upper chair on which the child sits supported by a lower base.

While such a device satisfactorily raises a child to table level, it has several disadvantages. A great number of these devices are used by family-style restaurants to boost young customers. Typically, these family style restaurants have several booster seats. The box-like devices are bulky and take up a great deal of storage space.

A further problem with these devices is that they can only boost the young customer to a specific height. As previously seen, these booster seats are used by young children varying in height as much as 12 inches. In order to accommodate such different size children, boxes having different heights and upper chair sizes must be used. This adds appreciably not only to the storage space needed for such devices but also to restaurant costs.

Efforts to reduce the disadvantages associated with such booster seats have been two-fold. Initially, a number of booster seats have been designed specifically to stack on each other. Such booster seats typically employ legs or a base which in storage fits around or in the upper chair of a second booster seat. While such booster seats do decrease the storage space over the box-like devices, different size booster seats are still needed to accommodate different size children.

A second attempt at a solution was the inclusion of a second upper chair on the backside of the first upper chair of the box-like device to provide for different heights of boost in the same device. While this does reduce the number of booster seats needed, such devices are still extremely bulky in storage. A further problem is the devices are "one size fits all" and therefore a small child must use a seat area that is too large or a large child's seat area is too small.

Thus, what is needed is a booster seat that eliminates both the storage bulk and the size constraints of booster seats of the prior art. Such a booster seat should provide for use by different size children and still be nestable for easy storage. The present invention meets these desires.

SUMMARY OF THE INVENTION

The present device provides a booster seat having two chair portions each having a seat surface, a back support and two arm supports which define seat pockets. The outer periphery of the back support and arm supports of the first chair portion define an outer circumference which is small enough to nest in the second seat pocket. Both the first chair portion and the second chair portion are able to act as bases, and are connected to each other such that the first chair portion acts as a base for the second chair portion and the second chair portion acts as a base for the first chair portion.

In a preferred embodiment, the first chair portion, back support and arm supports can be shorter than the second chair portion back support and arm supports and the first chair portion and the second chair portion can face opposite each other. The booster seat thus provides for two different booster heights and two corresponding different size seat pockets. Because of the design of this booster seat, it is also capable of nesting in a second booster seat for easy storage. This reduces not only the expense of maintaining several different sizes of booster seats, but also the storage problems of such different sizes.

DETAILED DESCRIPTION OF A PREFERRED EMBODIMENT

Figure 1:
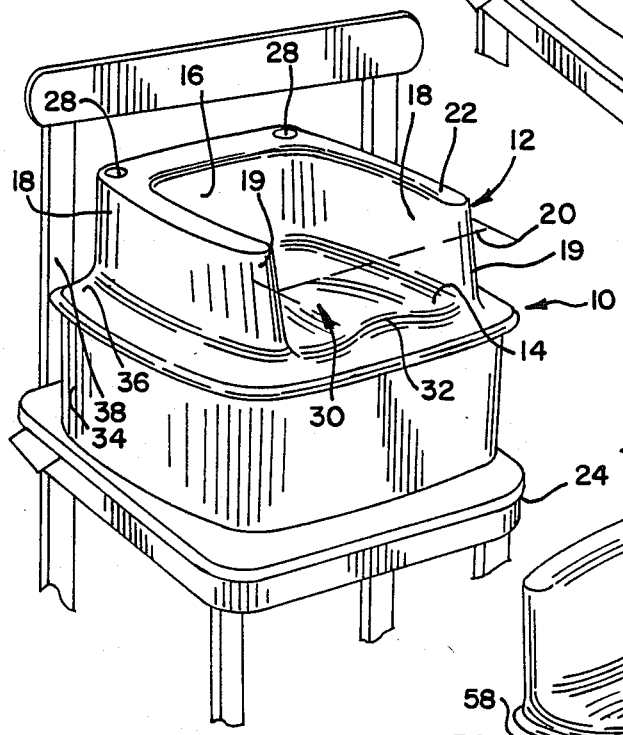
FIG. 1 is a perspective overview of a preferred embodiment of a booster, seat in accord with the present invention shown on an adult chair.

Referring to FIG. 1, a preferred embodiment of a booster seat in accord with the present invention is indicated generally by the reference numeral 10. The booster seat 10 includes a first chair portion 12 having a seat surface 14, a back support 16 and a pair of arm supports 18. The outer periphery of the back support 16 and arm supports 18 defines an outer circumference 20 of the first chair portion 12.

The back support 16 and arm supports 18 define a first rim 22 which preferably defines a substantially planar surface. When the booster seat 10 is inverted with the first chair portion 12 on the bottom (as in FIG. 2) and positioned on a generally flat surface, such as an adult chair 24, the first rim 22 rests securely against the generally flat surface. Thus, the first chair portion back support 16 and arm supports 18 act as a base 26 when in the inverted position (see FIG. 2). To prevent slippage when in use as a base 26, the first rim 22 can also include anti-skid means or pads such as a rubber bar or a plurality of rubber feet 28 which rest against the flat surface.

The seat surface 14, back support 16, and arm supports 18 together define a first seat pocket 30 in which a child sits. While the first seat surface 14 is generally planar, the seat surface 14 is also preferably contoured to fit the posterior of the child. Thus, a triangular shaped raised portion 32 can be provided in the front middle of the seat surface 14 which fits between the child's legs to provide comfort and to help to prevent the child from slipping out the seat pocket 30. Further, the arms supports 18 can be crescent shaped along a given radius (r) to provide contour for a more comfortable seat pocket 30 and to help to prevent the child from slipping.

Finally, the first chair portion 12 is supported by a base 34. Because the base 34 is wider than the outer circumference 20 of the first chair portion 12, the base 34 includes a ridge 36 extending outwardly from the outer circumference of the first chair portion 12.

Figure 2:
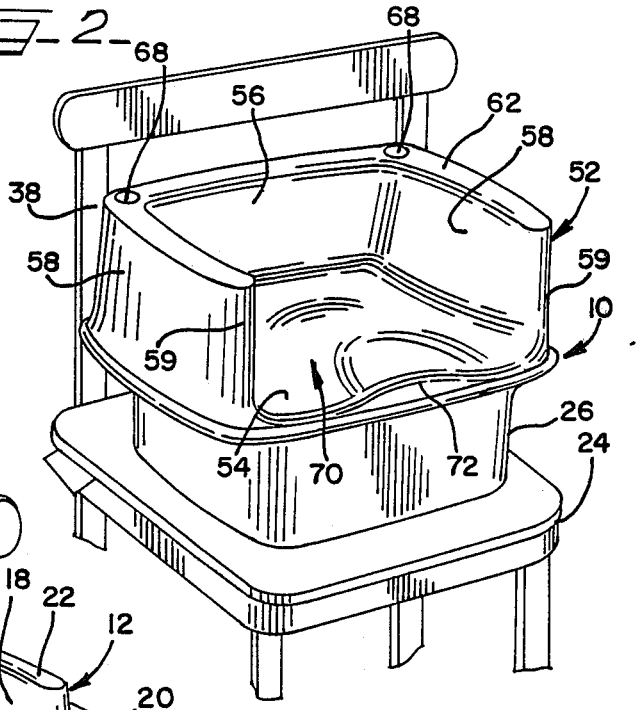
FIG. 2 is a perspective overview of the booster seat of FIG. 1 inverted on the adult chair.

Referring to FIG. 2, the booster seat is again indicated by the reference numeral 10. The booster seat 10 has been inverted with respect to its position seen in FIG. 1. The booster seat 10 includes a second chair portion 52 which also includes a seat surface 54, a back support 56 and two arm supports 58.

The back support 56 and arm supports 58 define a second rim 62 which preferably defines a substantially planar surface. When the booster seat 10 is inverted with the second chair portion 52 on the bottom (as in FIG. 1) and positioned on a generally flat surface, such as an adult chair 24, the second rim 62 acts as a base 34 (see FIG. 1). The second rim 62 of the second chair portion back support 56 and arm supports 58 can also include anti-skid means or pads such as a rubber bar or a plurality of rubber feet 68 to rest against the flat surface and prevent slippage.

The second chair portion seat surface 54, back support 56 and arm supports 58 together define a second seat pocket 70 in which a child sits. The seat surface 54 is also generally planar but can again include a triangular shaped raised portion 72 in the front middle to contour to the child's posterior for comfort and to prevent slippage. The arm supports 58 can again be crescent shaped along the same radius (r) as the first chair portion arm supports 18 to again provide comfort for the child and to help prevent the child from slipping.

The first chair portion seat surface 14 and the first chair portion raised triangular section 32 are smaller than the second chair portion seat surface 54 and the second chair portion raised triangular section 72. Further, the first chair portion back support 16 and arm supports 18 do not extend as high as the second chair portion back supports 56 and arm supports 58. The first chair portion seat pocket 30 is proportioned smaller than the second chair portion seat pocket 70 thereby making the first chair portion 12 suitable for a smaller child than the second chair portion 52.

Booster seats are typically needed by children between the ages of about 18 months and 5 years. A suitable booster seat for these age groups has a first chair portion with a seat surface of about 8.5 inches (22 cm) in width by about 8 inches (20 cm) in depth. The back support and arm supports can be about 3 inches (8 cm) in height, thus making the first chair portion suitable for children between the approximate ages of 18 months and 3 years.

The second chair portion of the suitable booster seat has a seat surface of about 11.5 inches (29 cm) in width by about 9.5 inches (24 cm) in depth. The back support and arm supports can be about 4.5 inches (10 cm) in height, thus making the second chair portion suitable for children between the approximate ages of 2½ and 5 years.

As previously seen, both the first chair portion 12 and second chair portion 52 act as bases when inverted. The first chair portion 12 and second chair portion 52 are connected seat to seat at the lower periphery of each such that when the first chair portion 12 is upright, the second chair portion 52 is the base 34 and when the second chair portion 52 is upright, the first chair portion 12 is the base 26. The first chair portion 12 and the second chair portion 52 also preferably face opposite with respect to each other such that when the first chair portion 12 is upright, the base 34 defined by the second chair portion 52 opens towards the adult chair 24 back support 38. This prevents the child from extending his legs under the chair portions and upsetting the booster seat 10. In addition, the front 19, 59 of the arm supports 18, 58 can be tapered at an angle generally corresponding to the adult chair 24 back supports 38 so the booster seat 10 can be stabilized against the adult chair 24 back support 38.

The generally planar seat surface 14 of the first chair portion 12 is approximately parallel to the substantially planar surface of the second rim 62 and the generally planar seat surface 54 of the second chair portion 52 is approximately parallel to the substantially planar surface of the first rim 22. As such, when the second rim 62 is rested against a flat surface, the seat surface 14 of the first chair portion 12 is appropriately positioned for seating while when the first rim 22 is rested against a flat surface, the seat surface 54 of the second chair portion 52 is positioned appropriately for sitting. In an alternative embodiment, the seating surfaces 14, 54 are tilted slightly back from parallel. Thus, when sitting on the respective bases, this tilt further keeps the children from sliding out of the seat pockets 30, 70.

Also as previously seen, the first chair portion 12 has shorter back support 16 and arm supports 18. Thus, when the second chair portion 52 is upright, it is boosted by the first chair portion 12 acting as its base 34 a lesser degree than when the first chair portion 12 is upright and boosted by the second chair portion 52. This is particularly advantageous as the second chair portion 52 is suited for larger children and therefor less of a boost is needed.

In the booster seat suitable for children between the ages of about 18 months and 5 years previously described, the back support and arm supports having a height of about 3 inches (8 cm) boost the second chair portion about 4 inches (10 cm). The back support and arm supports having a height of about 4.5 inches (10 cm) boost the first chair portion about 6 inches (15 cm). These boosts are suitable for children who can fit in the respective seat pockets.

The booster seat 10 is preferably made of a suitable, washable material such as plastic. A particularly suitable plastic is poly(propylene). In one embodiment, the first chair portion 12 and second chair portion 52 can be separately molded and permanently bonded together. In an alternative embodiment, the whole booster seat 10 is one integral piece which can be produced by blow molding of the plastic in a single mold. To help further prevent the child from slipping from the chair, the surface of the chair is preferably lightly textured to increase friction.

As previously seen, the second seat pocket 70 is larger than the first seat pocket 30. The second seat pocket 70 is also larger than the outer circumference 20 defined by the first chair portion back support 16 and arm supports 18. Thus, the first chair portion 12 is capable of fitting or nesting in the second chair portion seat pocket 70.

Figure 3:
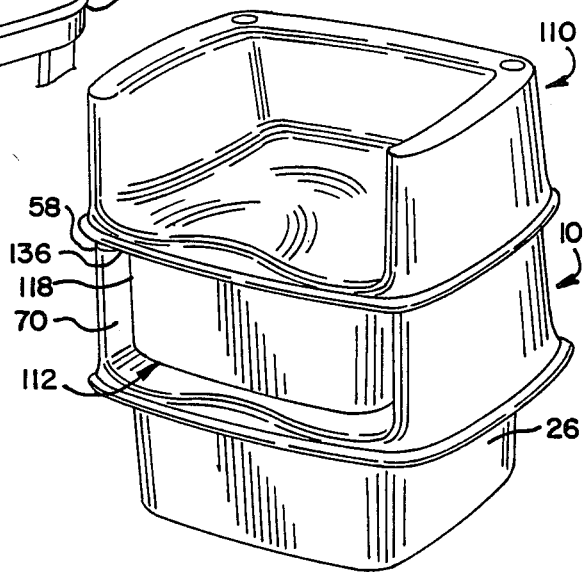
FIG. 3 is a perspective view of two booster seats in accord with the present invention stacked for storage.

Referring to FIG. 3, the nesting of a first chair portion 112 of a second booster seat 110 in the second seat pocket 70 of the booster seat 10 can be seen. The ridge 136 extending outwardly from the first chair portion arm supports 118 rests against the second rim 62 to provide stability while the two booster seats 10, 110 are nested. In this position, the anti-skid pads rest against the ridge 136 to act as retaining means to prevent the nested booster seat 110 from sliding. The crescent shaped arm supports 58, 118 also fit within each other to further act as retaining means against sliding. In a like manner, a plurality of booster seats can be nested thereby cutting storage space by nearly 50 percent.

It should be understood that various modifications, changes and variations in addition to those herein discussed may be made in the arrangement, operation and details of construction of the elements disclosed herein without departing from the spirit and scope of the invention.

What is claimed is:

1. A booster set for use by a child in association with an adult seat comprising:

a first chair portion having a seat surface, a back support and a pair of arm supports together defining a first seat pocket, the outer periphery of the back support and arm supports defining an outer circumference of the first chair portion, and the back supports and arm supports together defining a first rim and being capable of acting as a base to rest on the adult seat;

a second chair portion having a seat surface, a back support and a pair of arm supports defining a second seat pocket, the second seat pocket being larger than the outer circumference of the first chair portion, and the back support and arm supports together defining a second rim and being capable of acting as a base to rest on the adult seat; and the first chair portion and the second chair portion being permanently connected such that (a) the first chair portion and the second chair portion face opposite with respect to each other to restrict placement of the child's legs under the seat and to thereby deter the child from upsetting the seat and (b) the back support and arm supports of the first chair portion act as a base for the second chair portion and the back support and arm supports of the second chair portion act as a base for the first chair portion whereby the first chair portion of one booster seat can be nested within the second chair portion of a second booster seat.

2. The booster seat of claim 1 wherein the first chair portion back and arm supports are shorter than the second chair portion back and arm supports.

3. The booster seat of claim 1 wherein the seat surfaces of the first and second chair portions generally include a triangular raised portion in the front of the respective seat surfaces to match body contour.

4. The booster seat of claim 1 wherein the first and second rims include anti-skid means to prevent slippage when the respective rim is in use as a base.

5. The booster seat of claim 1 wherein the back support and arm supports of the respective chair portions are integral.

6. The booster seat of claim 1 where the first and second chair portions are integral.

7. The booster seat of claim 1 wherein the booster seat is made of plastic.

8. A booster seat for use by a child in association with an adult seat having a generally flat surface comprising:

a first chair portion having a generally planar seat surface, a back support and two arm supports, the back support and two arm supports together defining an outer circumference and a first rim having a substantially planar surface;

a second chair portion permanently connected to the first chair portion, the second chair portion having a generally planar seat surface, a back support and two arm supports, the back support and two arm supports together defining a second rim having a substantially planar surface and a seat pocket, the seat pocket being larger than the outer circumference of the first chair portion;

the first chair portion and the second chair portion facing opposite with respect to each other to restrict placement of the child's legs under the seat and to thereby deter the child from upsetting the seat; and the substantially planar surface of the first rim being substantially parallel to the second generally planar seat surface and the substantially planar surface of the second rim being substantially parallel to the first generally planar seat surface whereby when the first rim is positioned on the generally flat surface of the adult seat, the second generally planar seat surface is positioned appropriately for sitting and when the second rim is positioned on the generally flat surface of the adult seat, the first generally planar seat surface is positioned appropriately for sitting.

9. The booster seat of claim 8 wherein the distance between the second generally planar seat surface and the first rim is shorter than the distance between the first generally planar seat surface and the second rim.

10. The booster seat of claim 8 wherein the seat surfaces of the first generally planar sitting surface and the second generally planar sitting surface generally include a triangular raised portion in the front of the respective seat surfaces to match body contour.

11. The booster seat of claim 8 wherein the first rim and the second rim further include anti-skid means.

12. The booster seat of claim 8 wherein the first chair portion and the second chair portion are separate pieces permanently bonded together.

13. The booster seat of claim 8 wherein the first chair portion and the second chairs portions are integral.

14. The booster seat of claim 8 wherein the booster seat is made of plastic.

15. The booster seat of claim 8 wherein the back support and arm supports of the respective chair portions are integral.

* * * * *

UNITED STATES PATENT AND TRADEMARK OFFICE

CERTIFICATE OF CORRECTION

PATENT NO. : 4,867,504

DATED : September 19, 1989

INVENTOR(S) : Stanley A. Johnson, Jr.

It is certified that error appears in the above-identified patent and that said Letters Patent is hereby corrected as shown below:

In Claim 1, Col. 5, line 26, change "set" to --seat--.

Signed and Sealed this

Twenty-first Day of August, 1990

*Attest:*

HARRY F. MANBECK, JR.

*Attesting Officer*

*Commissioner of Patents and Trademarks*